US005402805A

United States Patent [19]

Barinas

[11] Patent Number: 5,402,805

[45] Date of Patent: Apr. 4, 1995

[54] ADJUSTABLE LEVEL BARRETTE DEVICE

[76] Inventor: Mary S. Barinas, 178 Stillwater Rd., Warren County, Blairstown, N.J. 07825

[21] Appl. No.: 297,584

[22] Filed: Aug. 29, 1994

[51] Int. Cl.[6] ..... A45D 24/38; A45D 8/22; A45D 8/30

[52] U.S. Cl. ..... 132/144; 132/133; 132/148; 132/279

[58] Field of Search ..... 132/144, 148, 278, 279, 132/219, 126, 129, 130, 132, 133, 134, 136, 135, 138, 145, 146

[56] References Cited

U.S. PATENT DOCUMENTS

| | | | |
|---|---|---|---|
| 5,348 | 4/1873 | Noyes | 132/146 |
| 62,606 | 5/1867 | Cassidey | 132/145 |
| D. 154,205 | 0/0000 | Kovacs et al. | 132/133 |
| 840,681 | 1/1907 | Becker | 132/133 |
| 1,052,310 | 2/1913 | Burlando | 132/279 |
| 1,525,051 | 2/1925 | Smith | 132/145 |
| 1,596,737 | 8/1926 | Johnson | 132/133 |
| 1,816,480 | 7/1931 | Goodman . | |
| 2,159,709 | 5/1939 | Quetin | 132/133 |
| 2,454,642 | 11/1948 | Finman . | |
| 2,859,754 | 11/1958 | Futterer . | |
| 2,902,042 | 9/1959 | Halber | 132/133 |
| 5,284,167 | 2/1994 | Gill | 132/144 |
| 5,335,680 | 8/1994 | Moore | 132/132 |

FOREIGN PATENT DOCUMENTS

| | | | |
|---|---|---|---|
| 384685 | 4/1908 | Belgium | 132/133 |

*Primary Examiner*—Paul J. Hirsch
*Attorney, Agent, or Firm*—Kenneth P. Glynn

[57] ABSTRACT

The present invention is directed to a multi-directional hairstyling adjustable level barrette device. It includes a barrette member which has a first elongated frame and a second elongated frame with each of these frames having a plurality of teeth. The first elongated frame and the second elongated frame each have a first end and a second end and the first end of these frames are hingedly connected to one another and the second ends of these frames have an attachment mechanism which permits them to be removably attachable to one another. The comb member has a plurality of teeth and it has a comb member attachment mechanism so that it can be attached to the barrette member at a plurality of locations along the elongated length of the barrette member. For example, the attachment mechanism may be hooks, snaps or slide-ins or other attachment mechanisms.

7 Claims, 3 Drawing Sheets

ADJUSTABLE LEVEL BARRETTE DEVICE

BACKGROUND OF THE INVENTION 1. Field of the Invention

The present invention is directed to a hairstyling adjustable level barrette device and more particularly such a device that includes a barrette member and a comb member with the barrette member first being attachable to hair, for example, in a vertical configuration, and, with the comb member being subsequently attached at various levels at right angles to the barrette member.

2. Information Disclosure Statement

Combs and barrettes go back thousands of years and numerous developments have been made over the past century relating to this field. The following is representative of the art:

U.S. Pat. No. 2,454,642 describes a comb which includes an adjustable member for curling hair, closing a latch and utilizing teeth to secure it on the head to permit curling.

U.S. Pat. No. 2,859,754 likewise describes a comb and this one utilizes mechanical fingers which are movable from a first to a second position, the first one being an open position, the second one being a closed position.

U.S. Pat. No. 1,816,480 describes a hair weaver which includes a comb and wire mechanism with lateral movement of the comb relative to the wire mechanism to hold portions of hair in place and move other portions of hair and hold them in place so as to create a wave and, due to application of the device over time, the user can make waves.

Notwithstanding the above prior art, there is no teaching that anticipates or renders obvious the present invention device utilizing a barrette member with an adjustable level attachment thereto.

SUMMARY OF THE INVENTION

The present invention is directed to a multi-directional hairstyling adjustable level barrette device. It includes a barrette member which has a first elongated frame and a second elongated frame with each of these frames having a plurality of teeth. The first elongated frame and the second elongated frame each have a first end and a second end and the first end of these frames are hingedly connected to one another and the second ends of these frames have an attachment mechanism which permits them to be removably attachable to one another. The comb member has a plurality of teeth and it has a comb member attachment mechanism so that it can be attached to the barrette member at a plurality of locations along the elongated length of the barrette member. For example, the attachment mechanism may be hooks, snaps or slide-ins or other attachment mechanisms.

BRIEF DESCRIPTION OF THE DRAWINGS

The present invention should be more fully understood when the specification herein is taken in conjunction with the drawings appended thereto, wherein.

DETAILED DESCRIPTION OF THE PRESENT INVENTION

The present invention device involves an adjustable level barrette device and it includes a barrette member and a comb member. The adjustable level may be infinitely adjustable, that is, the comb member may be attached anywhere along the elongated length of the barrette member, or it may have selected positions based on slots, indentations, ratchets, grooves, orifices or otherwise so that along the length of the barrette member would be specific locations for receiving the comb member. The comb member would be attachable by any non-attachment means and any such attachment means would be within the scope of the present invention. This could include sliding loops, snap-ins, male and female connectors, even less desirable velcro attachments or other attachment means without exceeding the scope of the present invention. Further, the components, that is the barrette member and the comb member, of the present invention device may be constructed with any known material and may be plastic, composite graphite, ceramic, wood, metal, glass or combinations of these or any other raw material which would be adequately rigid and durable to constitute a hair piece.

Figure 1:
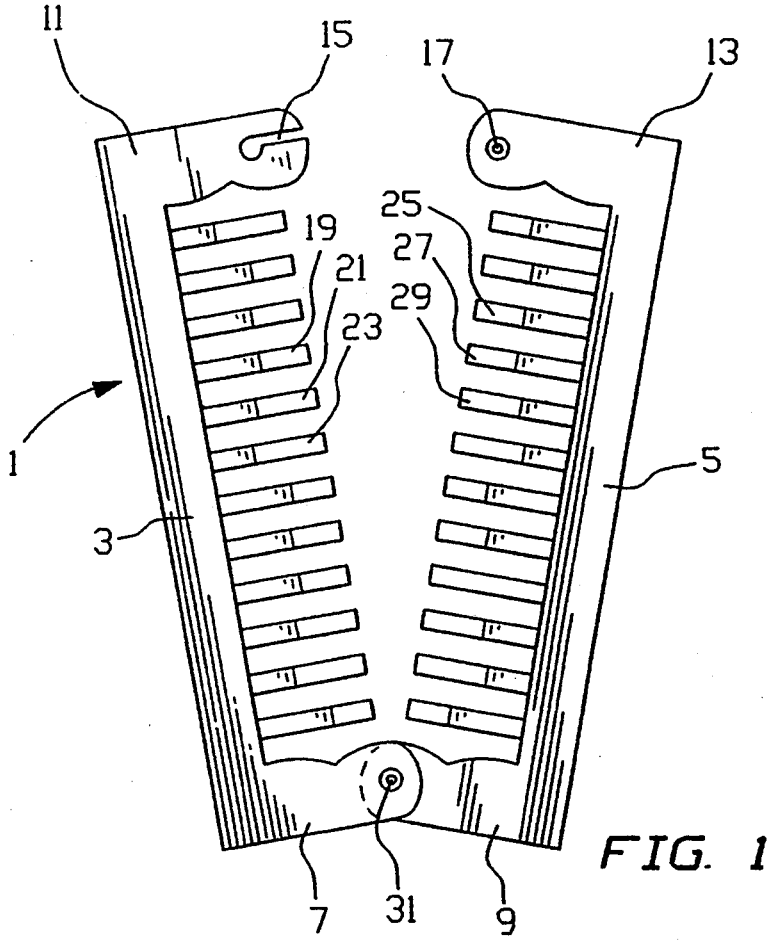
FIG. 1 shows a front view of a barrette component of a present invention hairstyling adjustable level barrette device and, FIG. 2 shows a front view of the comb member of that present invention device.

Referring now to FIG. 1 there is shown a front view of a present invention barrette member 1. It includes a first elongated member 3 and a second elongated member 5. They have first ends 7 and 9, respectively and second ends 11 and 13, respectively. First ends 7 and 9 of elongated members 3 and 5 are hingedly connected to one another so as to be rotatable relative to one another and, in this case, are connected by a rivet 31. Elongated members 3 and 5 include teeth such as teeth 19, 21 and 23 on elongated member 3 and teeth 25, 27 and 29 on elongated member 5. At second ends 11 and 13 of elongated members 3 and 5, respectively, there are located attachment means for removably connecting these ends to one another. In this case, elongated member 3 has a female slot 15 and elongated member 5 has a male peg 17 so that peg 17 slides into female slot 15 for removable attachment of elongated member 3 to elongated member 5. Thus, a user would take this device in its open position as shown, and the comb would then be used to close upon the hair so as to create a flow of hair in linear alignment consistent with the teeth (the teeth are exaggerated for illustration and would more likely be thinner or even tapered like most comb teeth.) The user would then snap together second ends 11 and 13 to one another so that the hair would be held in place. If this were done in a vertical manner, then the hair would appear to stream out in a linear vertical fashion, for example, in the middle of the back of the head, to some extent, but would, due to gravity, hang down and spread out somewhat, but the hair would be projecting outwardly along the entire length of the elongated members 3 and 5 between their first ends and their second ends. The user would then use the comb member shown in FIG. 2.

Figure 2:
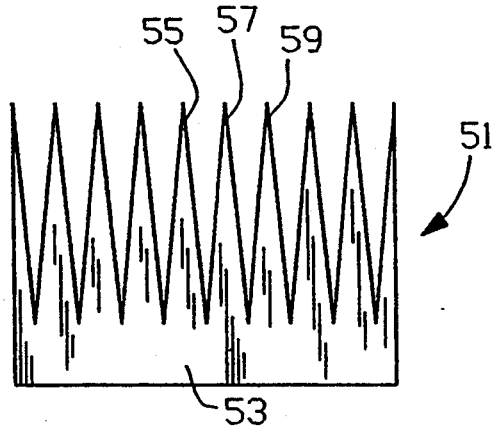
Figure 3:
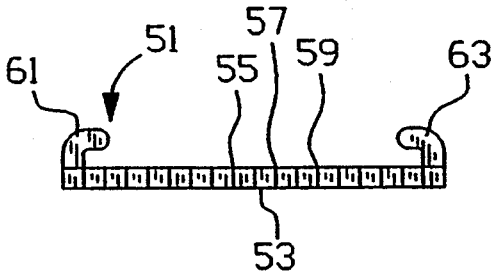
FIG. 3 shows a top view of the comb member of the present invention device shown in FIG. 2.

Referring now to FIGS. 2 and 3, there is shown comb member 51 with its main body 53 and a plurality of elongated teeth such as teeth 55, 57 and 59. There are clasping hooks 61 and 63 which are adapted to go onto the outside of elongated members 3 and 5. Although now shown, elongated members 3 and 5 could have a series of indentations or grooves on their underside so as to render comb member 51 attachable in specific slots rather than anywhere along its length. In any event, the user would, after positioning barrette member 1 in place, then comb the fallen hair upwardly using comb member 53 and attaching comb member 53 to barrette member 1 to achieve the desired result.

Figure 4:
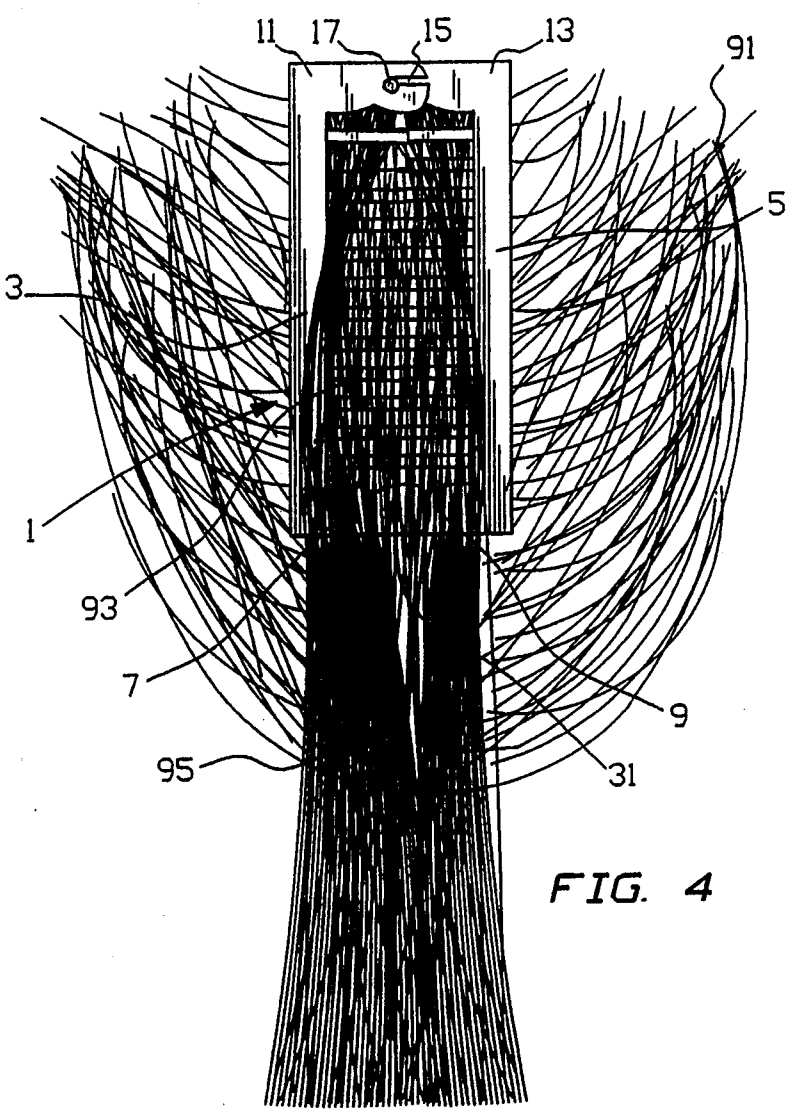

Referring to FIG. 4, there is shown a head of hair 91 with present invention device barrette member 1 in locked place in a vertical position so as to permit the hair to be aligned more vertically than horizontally in terms of the hair falling naturally, outwardly and downwardly therefrom, and would create a pull of the hair behind the barrette member to be somewhat horizontal, as shown. All the parts numbered in the previous figures are identically numbered herein. There is a portion of hair 93 which protrudes outwardly and hangs downwardly so as to form the "tail" 95.

Figure 5:
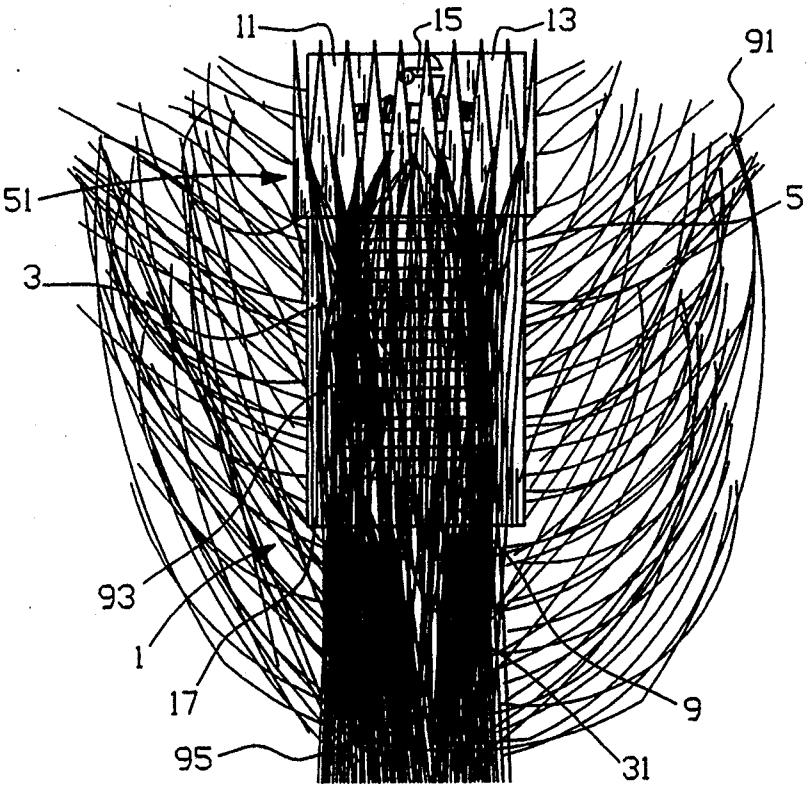
FIG. 4 shows the barrette member of FIG. 1 in its attached position on a lengthy head of hair and FIG. 5 shows the same device followed by the comb member being attached thereto with the head of hair now being lifted upwardly with the comb member being attached to the a barrette member, as shown; and, FIG. 6 shows a top view of an alternative barrette member for a present invention device.

Referring to FIG. 5, the identical head of hair 91 which is shown in FIG. 4 is shown here, except that comb member 51 has now been used to pull up the hair and create a rather unique ponytail which sweeps upwardly on its underside and back downwardly through comb member 51. As mentioned above, the present invention device need not be used in a horizontal, vertical fashion, but could be used in a angled position, on the top of the head, or otherwise. It could even be used with smaller versions on the sides of the head to create double ponytails.

Figure 6:
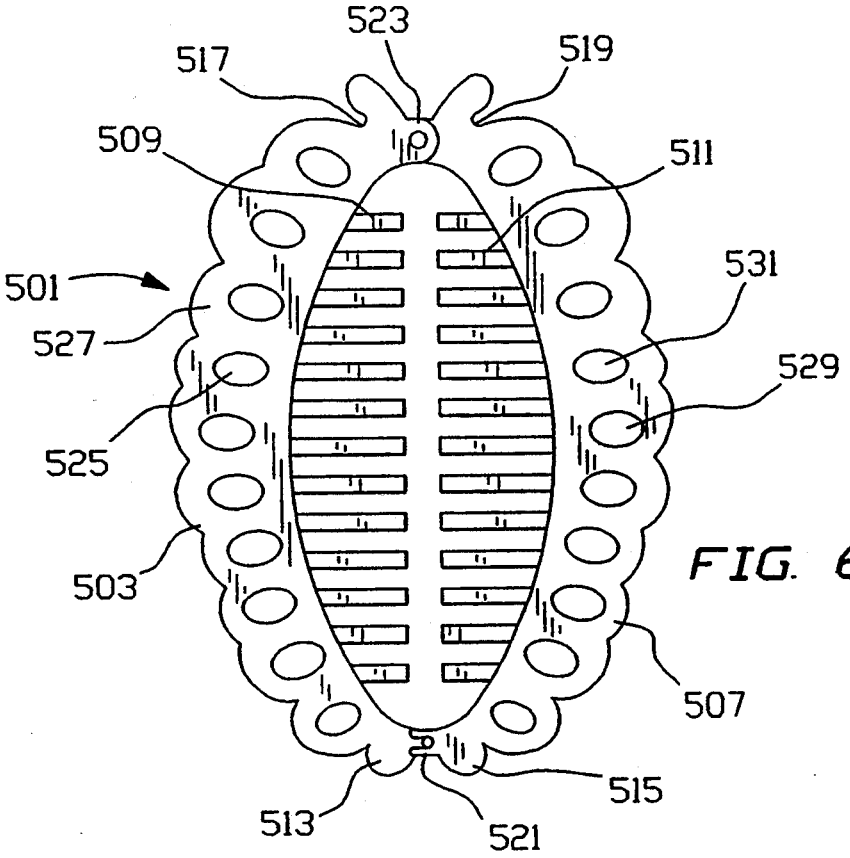
Figure 7:
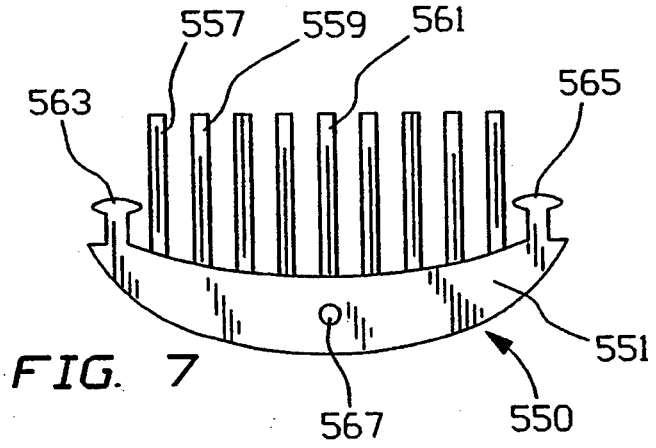
FIG. 7 shows the comb member of that device and FIG. 8 shows a top oblique view of a bow for decorative attachment to the comb member shown in FIG. 7.

FIGS. 6 and 7 show an alternative embodiment present invention, with FIG. 6 showing a top view of barrette member 501 and FIG. 7 showing comb member 550. FIG. 6 shows the barrette member 501 in its closed position and it has elongated members 503 and 507 with first ends 513 and 515 and second ends 517 and 519, respectively. There are included a plurality of teeth such as teeth 509 and 511 on the elongated members 503 and 507, as shown. Additionally, there is an attachment mechanism 523, in this case, a male/female snap-in connection. Also, along the elongated members 503 and 507 are a plurality of holes such as holes 525, 527, 529 and 531. These are adapted to receive the male counterparts connected to the comb 550 shown in FIG. 7.

Referring to FIG. 7, there is shown comb member 550 with a main base 551 and a plurality of teeth such as teeth 557, 559 and 561. Also, comb member 550 includes male counterparts 563 and 565.

The device shown in FIGS. 6 and 7 are used in a manner similar to the devices shown in the previous figures and described above. Additionally, there is an orifice 567 shown in comb member 550 which is adapted to receive ornamental attachments.

Figure 8:
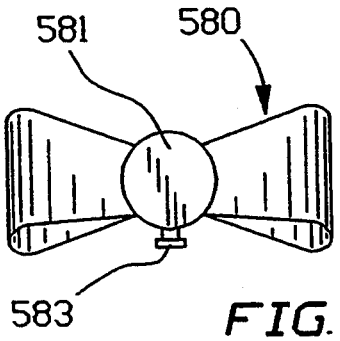

For example, FIG. 8 shows a bow 580 having a central solid portion 581 and a male snap-in member 583 adapted to be inserted into orifice 567. This could be one of a set of different colors of bows or other decorative items and could be interchangeable so as to enable a user to dress down or dress-up depending upon the ornamental attachment and so as to enable the user to attach theme ornaments such as a Christmas decoration, an Easter decoration or otherwise.

Obviously, numerous modifications and variations of the present invention are possible in light of the above teachings. It is therefore understood that within the scope of the appended claims, the invention may be practiced otherwise than as specifically described herein.

What is claimed is:

1. A multi-directional hair styling adjustable level barrette device, which comprises:

(a) a barrette member having a first elongated frame and a second elongated frame, each of said frames having a plurality of teeth, said first elongated frame and said second elongated frame each having a first end and second end, said first elongated frame and said second elongated frame being hingedly connected to one another at their first ends so as to be rotatable relative to one another, said first elongated frame and said second elongated frame having attachment means at their second end so as to be removably attachable to one another, said barrette member having means for attaching a comb member thereto at a plurality of locations along its elongated length; and, (b) a comb member having a plurality of comb teeth and having comb member attachment means thereon for attaching said comb member to said barrette member at at least one of a plurality of locations along said elongated length of said barrette member.

2. The device of claim 1 wherein said teeth of said comb member are orientated at approximately right angles to said teeth of said barrette member when said comb member is attached to said barrette member.

3. The device of claim 1 wherein said comb member is infinitely adjustable along the length of said elongated members of said barrette member.

4. The device of claim 1 wherein said barrette member and said comb member are separate pieces which are removably attachable to one another.

5. The device of claim 2 wherein said barrette member and said comb member are separate pieces which are removably attachable to one another.

6. The device of claim 3 wherein said barrette member and said comb member are separate pieces which are removably attachable to one another.

7. The device of claim 1 wherein said barrette member and said comb member are formed of plastic material.

* * * * *